US011767761B2

(12) United States Patent
Carlson et al.

(10) Patent No.: US 11,767,761 B2
(45) Date of Patent: Sep. 26, 2023

(54) LOW SOLIDITY VEHICLE COOLING FAN

(71) Applicant: Horton, Inc., Roseville, MN (US)

(72) Inventors: Tristan Carlson, Woodbury, MN (US); Scott Miller, Edina, MN (US)

(73) Assignee: HORTON, INC., Roseville, MN (US)

( * ) Notice: Subject to any disclaimer, the term of this patent is extended or adjusted under 35 U.S.C. 154(b) by 268 days.

(21) Appl. No.: 17/261,139

(22) PCT Filed: Jul. 12, 2019

(86) PCT No.: PCT/US2019/041545
§ 371 (c)(1),
(2) Date: Jan. 18, 2021

(87) PCT Pub. No.: WO2020/028010
PCT Pub. Date: Feb. 6, 2020

(65) Prior Publication Data

US 2021/0317842 A1 Oct. 14, 2021

Related U.S. Application Data

(60) Provisional application No. 62/713,668, filed on Aug. 2, 2018.

(51) Int. Cl.
*F01D 5/14* (2006.01)
*F04D 19/00* (2006.01)
(Continued)

(52) U.S. Cl.
CPC ..... *F01D 5/141* (2013.01); *F01P 7/081* (2013.01); *F04D 19/002* (2013.01); *F04D 29/325* (2013.01); *F04D 29/384* (2013.01)

(58) Field of Classification Search
CPC ..... F01D 5/141; F01D 5/147; F01P 7/081; F04D 29/325; F04D 29/38; F04D 29/384; F04D 29/386
(Continued)

(56) References Cited

U.S. PATENT DOCUMENTS 1,041,913 A 10/1912 Tyson
1,512,273 A 10/1924 Callahan
(Continued)

FOREIGN PATENT DOCUMENTS

DE 3304296 A 9/1983
DE 29903619 U1 5/1999
(Continued)

OTHER PUBLICATIONS

BorgWarner, photo of LD7 Polymer Fan with added markings (fan in photo purchased Mar. 2005), 1 page.
(Continued)

*Primary Examiner* — Woody A Lee, Jr.
*Assistant Examiner* — Justin A Pruitt
(74) *Attorney, Agent, or Firm* — Westman, Champlin & Koehler, P.A.

(57) ABSTRACT

An axial flow fan for use with a vehicle cooling system includes a hub defining an axis of rotation, and at least five blades supported on the hub. Each blade includes a leading edge, a trailing edge opposite the leading edge, a pressure side extending between the leading edge and the trailing edge, a suction side opposite the pressure side, a tip, and a root opposite the tip along a blade length. A solidity of the axial flow fan, measured as a percentage of an annular flow area between an outer diameter of the hub and an outer diameter of the tips of the blades projected onto a plane perpendicular to the axis of rotation that is occupied by the blades, is less than 40%.

19 Claims, 13 Drawing Sheets

(51) Int. Cl.
*F04D 29/32* (2006.01)
*F04D 29/38* (2006.01)
*F01P 7/08* (2006.01)

(58) Field of Classification Search
USPC ..... 416/223 R
See application file for complete search history.

(56) References Cited

U.S. PATENT DOCUMENTS

| | | | | |
|---|---|---|---|---|
| 1,827,225 | A | 10/1931 | Ferreby | |
| 3,885,888 | A | 5/1975 | Warhol | |
| 4,187,055 | A | 2/1980 | Barnstead | |
| 4,364,712 | A | 12/1982 | Charles | |
| 4,451,202 | A | 5/1984 | Hauser | |
| 4,564,337 | A * | 1/1986 | Zimmer | B64C 11/18 416/223 R |
| 5,044,885 | A | 9/1991 | Odoul et al. | |
| 5,066,196 | A | 11/1991 | Morofushi | |
| 5,088,892 | A | 2/1992 | Weingold et al. | |
| 5,193,608 | A * | 3/1993 | Sekine | B60K 11/08 165/44 |
| 5,193,981 | A | 3/1993 | Scheidel et al. | |
| 5,249,922 | A | 10/1993 | Sato et al. | |
| 5,273,400 | A * | 12/1993 | Amr | F04D 29/386 416/189 |
| 5,695,318 | A | 12/1997 | Harmsen | |
| 5,906,179 | A | 5/1999 | Capdevila | |
| 6,010,305 | A | 1/2000 | Hauser | |
| D446,295 | S | 8/2001 | Williams et al. | |
| 6,302,650 | B1 | 10/2001 | Williams et al. | |
| 6,315,521 | B1 * | 11/2001 | Hunt | F04D 29/386 416/192 |
| 6,340,292 | B1 | 1/2002 | Chuang et al. | |
| 6,341,940 | B1 | 1/2002 | Giribaldi | |
| 6,358,009 | B1 | 3/2002 | Link | |
| 6,375,427 | B1 | 4/2002 | Williams et al. | |
| 6,382,915 | B1 * | 5/2002 | Aschermann | F04D 25/022 416/169 A |
| 6,468,037 | B1 | 10/2002 | Link | |
| 6,548,929 | B2 | 4/2003 | Nelson et al. | |
| 6,565,320 | B1 | 5/2003 | Surls et al. | |
| 6,659,724 | B2 | 12/2003 | Takeuchi et al. | |
| 6,726,445 | B2 | 4/2004 | Tsuchiya et al. | |
| 6,726,454 | B2 | 4/2004 | Blass et al. | |
| 6,969,232 | B2 * | 11/2005 | Zess | F04D 29/681 416/193 A |
| 7,331,764 | B1 | 2/2008 | Reynolds et al. | |
| 7,585,159 | B2 | 9/2009 | Caplan et al. | |
| 7,600,980 | B2 | 10/2009 | Sato | |
| 8,091,177 | B2 | 1/2012 | Coté et al. | |
| 8,100,664 | B2 | 1/2012 | Hwang et al. | |
| 8,240,996 | B2 | 8/2012 | Surls | |
| 8,408,371 | B2 | 4/2013 | Schultheiss et al. | |
| 8,459,967 | B2 | 6/2013 | Kleber | |
| 8,985,970 | B2 | 3/2015 | Spaggiari et al. | |
| 9,017,030 | B2 * | 4/2015 | Beeck | F01D 5/141 416/193 A |
| 9,217,331 | B1 | 12/2015 | Yellapragada et al. | |
| 9,217,443 | B2 | 12/2015 | He | |
| 9,447,791 | B2 | 9/2016 | Aschermann et al. | |
| 9,523,372 | B2 | 12/2016 | Stagg | |
| 9,790,955 | B2 | 10/2017 | Scouarnec et al. | |
| 9,829,011 | B2 | 11/2017 | Larpent | |
| 9,835,077 | B2 | 12/2017 | Burt | |
| D860,427 | S | 9/2019 | Cayton | |
| 10,907,648 | B2 * | 2/2021 | Vogiatzis | F04D 29/324 |
| 2004/0013526 | A1 | 1/2004 | Nilson | |
| 2008/0115745 | A1 | 5/2008 | Kawaike et al. | |
| 2008/0219849 | A1 | 9/2008 | Decker et al. | |
| 2013/0323072 | A1 | 12/2013 | Aschermann et al. | |
| 2014/0044575 | A1 | 2/2014 | Naffziger | |
| 2014/0341748 | A1 | 11/2014 | Kojima et al. | |
| 2015/0198177 | A1 | 7/2015 | Gabbin et al. | |
| 2017/0130724 | A1 | 5/2017 | Bielesch et al. | |
| 2017/0175762 | A1 | 6/2017 | Aschermann | |
| 2017/0184112 | A1 | 6/2017 | Blass | |
| 2018/0003190 | A1 | 1/2018 | Hamada et al. | |
| 2018/0087784 | A1 | 3/2018 | Sawada | |

FOREIGN PATENT DOCUMENTS

| | | | |
|---|---|---|---|
| DE | 102016002832 | A1 | 9/2017 |
| DE | 102016203892 | A1 | 9/2017 |
| DE | 102016206678 | A1 | 10/2017 |
| EP | 0654585 | A1 | 5/1995 |
| EP | 0515839 | B1 | 1/1996 |
| EP | 0463385 | B1 | 8/1996 |
| EP | 0887558 | B1 | 2/2004 |
| EP | 1851443 | B1 | 4/2010 |
| EP | 2886873 | A1 | 6/2015 |
| EP | 2975284 | A2 | 1/2016 |
| EP | 2478226 | B1 | 2/2016 |
| EP | 2638295 | B1 | 1/2017 |
| EP | 2646695 | B1 | 7/2017 |
| EP | 2381112 | B1 | 10/2017 |
| GB | 632112 | A | 11/1949 |
| JP | H08240197 | A | 9/1996 |
| JP | 3406733 | B2 | 5/2003 |
| JP | 2007063989 | A | 3/2007 |
| JP | 2015209832 | A | 11/2015 |
| WO | 0024112 | A1 | 4/2000 |
| WO | 2008141253 | A1 | 11/2008 |
| WO | 2015132077 | A1 | 9/2015 |
| WO | 2017017264 | A1 | 2/2017 |
| WO | 2017085134 | A2 | 5/2017 |
| WO | 2017093245 | A1 | 6/2017 |

OTHER PUBLICATIONS

BorgWarner "Polymer Fans" Web Page, <http://web.archive.org/web/20061113182542/http://www.borgwarner.com/products/thermal/polymer_fans/> (archived Nov. 13, 2006), 1 page.
BorgWarner "MD9 Polymer Fan" (2006), 2 pages.
BorgWarner "Polymer Fans" Product Sheet (2010), 2 pages.
BorgWarner "X Series Fans" Product Sheet (2010), 2 pages.
BorgWarner, "Explore Our Technologies: Polymer Fans" (Sep. 2017), 2 pages.
BorgWarner "Polymer Fans: Overview" Web Page,<http://web.archive.org/web/20070804224058/http://www.ets.borgwarner.com/pages-NorthAmer/products/products-fans.html> (archived Aug. 4, 2007).
"New BorgWarner Engine Fans," Fleet Owner, <http://web.archive.org/web/20081203191740/http://fleetowner.com/equipment/nutsbolts/fleet_new_borgwarner_engine> (archived Dec. 3, 2008), 2 pages.
BorgWarner "Thermal Systems" Product Sheet (accessed online Jul. 25, 2017), 7 pages.
BorgWarner "Products | Polymer Fans" Web Page <https://www2.borgwarner.com/en/Thermal/products/Pages/Polymer-Fans.aspx> (Jul. 25, 2017), 2 pages.
Horton, Inc. "HEHF FAN" Web Page <https://www.hortonww.com/on-highway/fans/hehf.html> (Jul. 25, 2017), 5 pages.
Horton, Inc. "HS9 Nylon Fan" Web Page <https://www.hortonww.com/on-highway/fans/hs9-standard-fan.html> (Jul. 25, 2017), 5 pages.
Horton, Inc. "HS11 Nylon Fan" Web Page<https://www.hortonww.com/on-highway/fans/hs11-standard-fan.html> (Jul. 25, 2017), 5 pages.
Horton, Inc. "MS9 Nylon Fan" Web Page <https://www.hortonww.com/on-highway/fans/ms9-standard-fan.html> (Jul. 25, 2017), 5 pages.
Horton, Inc. "Windmaster Molded Ring Fans" Web Page <https://www.hortonww.com/on-highway/fans/molded-ring-fans.html> (Jul. 25, 2017) 5 pages.
Horton, Inc. "Windmaster MS8 Nylon Standard Fan" Web Page <https://www.hortonww.com/on-highway/fans/ms8-standard-fans.html> (Jul. 25, 2017), 5 pages.
Horton, Inc. "Windmaster Nylon LS11 Standard Fans" Web Page <https://www.hortonww.com/on-highway/fans/ls11-standard-fans.html> (Jul. 25, 2017), 5 pages.

(56) References Cited

OTHER PUBLICATIONS

MAHLE Group, "Visco(R) fans and Visco(R) fan drives" Web Page <http://www.mahle.com/mahle/en/products-and-services/commercial-vehicles/cooling/visco-fans-and-visco-fan-drives/index.jsp> (Jul. 25, 2017), 1 page.
International Search Report and Written Opinion in International Patent Application No. PCT/US2019/041545, dated Nov. 5, 2019.
European Search Report in corresponding European patent application No. 19844761 dated May 9, 2022.

* cited by examiner

LOW SOLIDITY VEHICLE COOLING FAN

CROSS-REFERENCE TO RELATED APPLICATION(S)

This Application is a Section 371 National Stage Application of International Application No. PCT/US2019/041545, filed Jul. 12, 2019 and published as WO 2020/028010 A1 on Feb. 6, 2020, in English, and further claims priority to U.S. Provisional Patent Application Ser. No. 62/713,668, filed Aug. 2, 2018, the contents of each of which are hereby incorporated by reference in their entirety.

BACKGROUND

Embodiments of the present invention relate generally to vehicle cooling fans, vehicles utilizing such fans, and associated methods.

Heavy duty trucks spend long periods of time driving at steady states and relatively high vehicle speeds. An example of this is typical interstate driving on a freeway. When such a vehicle is being driven at relatively high speeds, motion of the vehicle is generally enough to cool the internal combustion (e.g., diesel) engine. As the vehicle travels forward, air is forced through one or more heat exchangers, cooling the engine. This air flow from vehicle motion is often referred to as ram air. Under conditions providing sufficient ram air, a fan does not need to be driven for engine cooling purposes. A typical truck or similar vehicle will employ a clutching mechanism that selectively disconnects the fan from the engine drivetrain in order to minimize parasitic power losses, which is typically referred to as the "off" condition. A clutch and associated fan can be placed in the "off" condition when sufficient ram air cooling is available.

However, the fan can still have an influence on engine cooling even in the "off" condition due to added restriction of flow from the fan. Fan solidity can be defined by the ratio of closed area of the fan's blades to the total annular area between circles defined by an outer diameter of the fan and a hub diameter. In other words, as used herein with respect to substantially axial flow fans, "solidity" is an areal measure of how much of the annular flow area measured perpendicular to an axis of rotation is occupied by fan blades and how much is open—this calculation of solidity differs from one based on chord divided by circumferential blade spacing. A high solidity fan has relatively little opening between the fan blades, if any, and a low solidity fan has relatively large openings. The greater the solidity of the fan, the more likely it is to restrict ram air flow when placed in the air stream in the un-driven state or "off" condition. Higher restriction reduces flow and the ability of the ram air flow to cool the engine, which can increase the need for the fan to be turned on occasionally to cool the engine when the fan might otherwise be off.

Running the fan can require a substantial amount of power, especially at higher fan speeds. Operation of the fan (i.e., an "on" condition) is required to cool the engine under worst case scenarios, which can include conditions where ambient temperature is high, engine load is high, and/or vehicle speed (and therefore ram air speed) is low. An example would be a fully loaded truck ascending a hill in a hot desert. Under conditions where ram air is unavailable or insufficient, the fan must develop enough pressure to draw the required cooling air flow through the vehicle's heat exchanger.

Fan solidity and the ability of the fan to build fluid pressure are related. In the same way a higher solidity fan creates more ram air resistance, in general, it also has the ability to provide more pressure, and thus more cooling flow. In this sense, while optimization of fan characteristics in isolation may suggest relatively high solidity fan designs, in order to build pressure more efficiently, such isolated fan design considerations fail to take into account the unique operating characteristics in which vehicle fans operate, because ram air cooling can avoid the need for fan operation under some circumstances. In this regard, fan design considerations used for cooling tower, air conditioner, and similar applications do not account for the unique range of conditions faced by vehicular engine cooling fans.

The current state of the art low solidity vehicular fan is typically a 6-bladed fan. For example, the BorgWarner PS6 fan (available from BorgWarner Inc., Auburn Hills, Mich., USA) shown in FIGS. 1A and 1B has been on the market for several years. The PS6 fan is molded at an outside diameter of 813 mm and the hub diameter is 330 mm. The area of the 813 mm circle is 519,124 $mm^2$ and the area of the circle defined by the hub area is 85,530 $mm^2$. The area of the annulus between the hub and the fan OD is 519,124-85,530=433,594 $mm^2$. The projected area of the blades only is 203,563 $mm^2$. Therefore, the solidity of the blades to the annular flow area of the BorgWarner PS6 fan is 203,563/433,594=0.469 or 46.9%. The BorgWarner PS6 fan therefore has a relatively high solidity, even if other comparable vehicular fans have even higher solidities. Other examples of known vehicular fans are disclosed in U.S. Pat. Nos. 5,906,179 and 6,565,320 and European Patent EP 1 851 443 B (also published as U.S. Pat. App. Pub. No. 2008/0156282).

It is desired to provide a fan with an alternative configuration.

SUMMARY

In one aspect, an axial flow fan for use with a vehicle cooling system includes a hub defining an axis of rotation, and a plurality of blades supported on the hub, the plurality of blades including at least five blades. Each blade includes a leading edge, a trailing edge opposite the leading edge, a pressure side extending between the leading edge and the trailing edge, a suction side opposite the pressure side, a tip, and a root opposite the tip along a blade length. A solidity of the axial flow fan, measured as a percentage of an annular flow area between an outer diameter of the hub and an outer diameter of the tips of the plurality of blades projected onto a plane perpendicular to the axis of rotation that is occupied by the plurality of blades, is less than 40%, less than 33%, or less than 25%. In some further aspects, a maximum total turning angle along the blade length of each of the plurality of blades is greater than 50°, greater than or equal to 80°, greater than or equal to approximately 89°, or approaches 90°. In some still further aspects, the total turning angle can vary along the blade length of each of the plurality of blades, and a minimum total turning angle along the blade length of each of the plurality of blades can be greater than or equal to 30°, or greater than or equal to 35°.

In another aspect, a vehicle includes an internal combustion engine, a heat exchanger for cooling the internal combustion engine, an axial flow fan with a solidity less than 40% (or less than 33% or less than 25%), and a clutch configured to selectively rotate the axial flow fan. The heat exchanger is exposed or is at least exposable to ram air when the vehicle is moving in at least one direction. The axial flow fan is positioned proximate to the heat exchanger, and rotation of the axial flow fan moves cooling air relative to the heat exchanger.

In yet another aspect, an axial flow fan includes a hub defining an axis of rotation, and exactly five blades integrally and monolithically formed with at least a portion of the hub. Each of the five blades is free-tipped and includes a leading edge, a trailing edge opposite the leading edge, a pressure side extending between the leading edge and the trailing edge, a suction side opposite the pressure side, a tip, a root opposite the tip along a blade length, and a hub ramp on the pressure side. A solidity of the axial flow fan, measured as a percentage of an annular flow area between an outer diameter of the hub and an outer diameter of the tips of the five blades projected onto a plane perpendicular to the axis of rotation that is occupied by the five blades, is less than 25% (or is approximately 22.7%). A maximum total turning angle along the blade length of each of the five blades is greater than or equal to 80° (or approaches 90°, or is approximately 89.2°).

The present summary is provided only by way of example, and not limitation. Other aspects of the present invention will be appreciated in view of the entirety of the present disclosure, including the entire text, claims and accompanying figures.

Figure 1A:
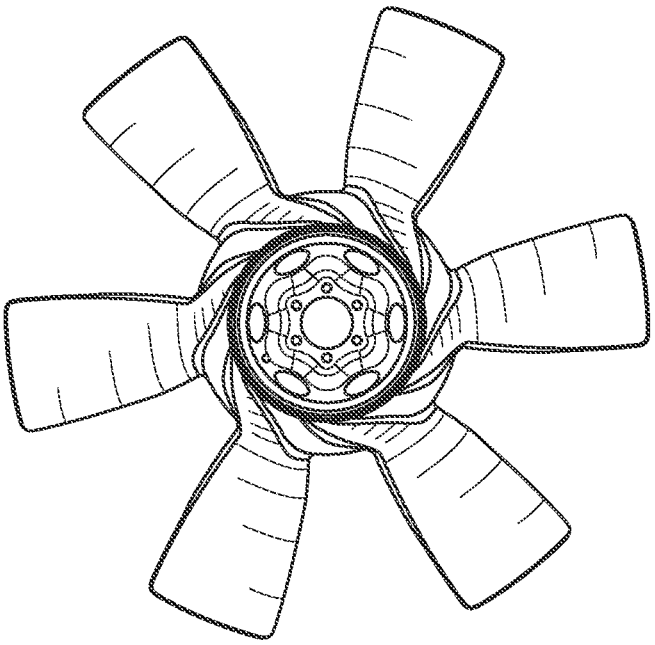
FIG. 1A (Prior Art)
FIGS. 1A and 1B are front and rear elevation views, respectively, of a prior art six-bladed automotive fan.

While the above-identified figures set forth one or more embodiments of the present invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features, steps and/or components not specifically shown in the drawings.

DETAILED DESCRIPTION OF ILLUSTRATIVE EMBODIMENTS

In vehicular cooling applications, it has been discovered that the expected effects of ram air flows can alter design considerations for engine cooling fans. There is a substantial desire to minimize the ram air flow resistance caused by the fan in order to allow free air flow (i.e., ram air) to cool the engine for a greater amount of time, saving power and fuel that would be require to power the fan in an "on" condition. However, because ram air will be unavailable or insufficient under some vehicular operating conditions, fan operation will still be required, and it is therefore desired to provide a relatively low solidity fan that still provides sufficient static pressure. For instance, a static pressure that is the same or greater than that of a higher solidity fan at most operating conditions, especially at higher speed and airflow conditions, is beneficial in some applications and embodiments. Embodiments of the present invention further accomplish those flow resistance and static pressure benefits without adding depth to the blades of the fan. The blade depth is the width or thickness of the fan when measured parallel to an axis of rotation, that is, the blade depth is the axial chord or pitch width. Thus, the present disclosure provides a relatively low solidity fan, such as a five-blade fan, with a solidity less than 40% (e.g., less than approximately 33%, or less than approximately 25%). Moreover, the fan of the present invention provides a unique blade shape with the ability to develop relatively high pressures in conjunction with only a small number of blades (e.g., five blades, or less than five blades) and a relatively low solidity (e.g., less than 40%, less than 33%, or less than 25%). A fan according to the present invention can be an axial flow fan, which generates a fluid flow in generally the axial direction. The fan can include free-tipped (e.g., unshrouded) blades, though in alternate embodiments one or more blades can be connected to a shroud ring or partial shroud segment. Numerous features and benefits of the present invention will be recognized by those of ordinary skill in the art in view of the entirety of the present disclosure, including the accompanying figures.

The present application is based on and claims the benefit of U.S. provisional patent application Ser. No. 62/713,668, filed Aug. 2, 2018, the content of which is hereby incorporated by reference in its entirety.

In one embodiment, shown in FIGS. 2 to 6, a fan 20 has a hub 22 and five blades 24. The blades 24 can each have the same shape, and are each supported on and extend outward from the hub 22. The fan 20 can be configured to rotate clockwise about an axis of rotation A when viewed from the front, as designated by the arrow R. Moreover, the fan 20 of the illustrated embodiment is configured as an axial flow fan, that is, the fan 20 generates fluid flow (e.g., air flow) substantially parallel to the axis A when rotated. Each blade 24 has a pressure side 24-1, a suction side 24-2, a leading edge (LE) 24-3, a trailing edge (TE) 24-4, and a tip 24-5. The LE 24-3 is located generally opposite the TE 24-4, and the pressure side 24-1 is located generally opposite the suction side 24-2. The pressure and suction sides 24-1 and 24-2 each extend between the LE 24-3 and the TE 24-4. A blade length is measured radially along the blades 24, with the tip 24-5 located at 100% of a total blade length. A root 24-6 of each blade 24 is located opposite the tip 24-5 at 0% of the total blade length. A thickness of the blades 24 is measured between the pressure and suction sides 24-1 and 24-2. A chord of each blade 24 is measured between the LE 24-3 and the TE 24-4. In the illustrated embodiment, the blades 24 are free-tipped. The fan 20 can further have a hub ramp 24-7 on a pressure side 24-1 of each blade 24 that extends upward (in both the radial and circumferential directions) from the hub 22. The hub ramps 24-7 can be generally planar, though in alternate embodiments the shape of the hub ramps 24-7 can vary as desired for particular applications. In the illustrated embodiment, each hub ramp 24-7 extends to the LE 24-3 but is spaced from the TE 24-4. The hub ramps 24-7 can produce some non-axial fluid flow during operation, though the fan 20 can still be considered to generate generally axial fluid flow. A portion of each blade 24 at the LE 24-3 can protrude axially forward of a front face 22-1 of the hub 22 and a portion of each blade 24 can protrude axially rearward of a rear edge 22-2 of the hub 22 at the TE 24-4. Moreover, a portion of each blade 24 at the LE 24-3 can extend radially inward from an outer diameter of the hub 22, forming a kind of scoop for fluid at the front face 22-1 of the hub 22. The blades 24 and at least a portion of the hub 22 can be made of a moldable polymer material (e.g., nylon, with or without reinforcement fibers, fillers, etc.) and can be integrally and monolithically formed together. The hub 22 can further have a metallic insert 22-3, which can have an open center, to facilitate attaching the fan 20 to a desired mounting location. The front face 22-1 of the hub 22 can be substantially planar.

An annular flow area of the fan 20 is established between a circle at an outer diameter (OD) of the fan 20 at the blade tips 24-5 and a circle an OD of the hub 22 projected onto a plane perpendicular to the axis of rotation A. Solidity of the fan 20 is measured based on the percentage of the annular flow area (as projected onto a plane perpendicular to the axis of rotation A) occupied by the blades 24, which indicates how much of the annular flow area perpendicular to an axis of rotation A is occupied by all of the blades 24 and how much is open (that is, having lines of sight parallel to the axis of rotation A being unobstructed by the blades 24). In the illustrated embodiment, the hub ramps 24-7 do not extend beyond the areas of the blades 24 as projected onto the plane perpendicular to the axis of rotation A, and therefore have no effect on the solidity measurement. But in alternate embodiments, hub ramps 24-7, flow modification features, or other structures that reside in the annular flow area of the fan 20 and that limit how much of that annular flow area is open are counted toward the solidity measurement.

In one embodiment, the OD of the five-blade fan 20 at the blade tips 24-5 can be 813 mm and the OD of the hub 22 can be 350 mm, though larger or smaller values of the outer or hub diameters can be larger or smaller in further embodiments, such as by scaling the indicated dimensions to larger or smaller values. A total area of an 813 mm OD circle in this embodiment is 519,124 $mm^2$ and an area of a 350 mm hub circle is 96,211 $mm^2$. An area of an annulus between the hub 22 and the fan OD at the tips 24-5 in this embodiment is 519,124-96,211=422,913 $mm^2$ The projected area of the five blades 24 is 96,211 $mm^2$, in the illustrated embodiment. Thus, the solidity within the annulus of the illustrated embodiment is 96,211/422,913=0.227 or 22.7%.

In the illustrated embodiment (see, e.g., FIG. 6), the blades 24 each have a relatively high camber, meaning a relatively high degree of curvature between the leading and trailing edges 24-3 and 24-4 measured as a total turning angle. The total turning angle is calculated as the difference between flow angles at the LE 24-3 and the TE 24-4. The flow angles are measured by projecting tangents to the pressure and suctions sides 24-1 and 24-2 of the blade 24 (i.e., tangents at pressure and suction side surfaces where those surfaces adjoin or transition to a radiused leading or trailing edge) to an intersection point, and bisecting the angle formed by the intersecting projected lines, then measuring the angle of the bisecting line with respect to the axial direction. For example, in some embodiments, the blades 24 can have a total turning angle measured as the difference between flow angles at the LE 24-3 and the TE 24-4 with a maximum over the entire blade length that approaches 90°, such as a maximum total turning angle of greater than 50°, greater than or equal to 60°, greater than or equal to 70°, greater than or equal to 80°, greater than or equal to 82°, or greater than or equal to 89°. Moreover, in some embodiments, a minimum total turning angle over the entire blade length can be greater than or equal to 30% or greater than or equal to 35%. The total turning angle can vary along the blade length.

Figure 8:
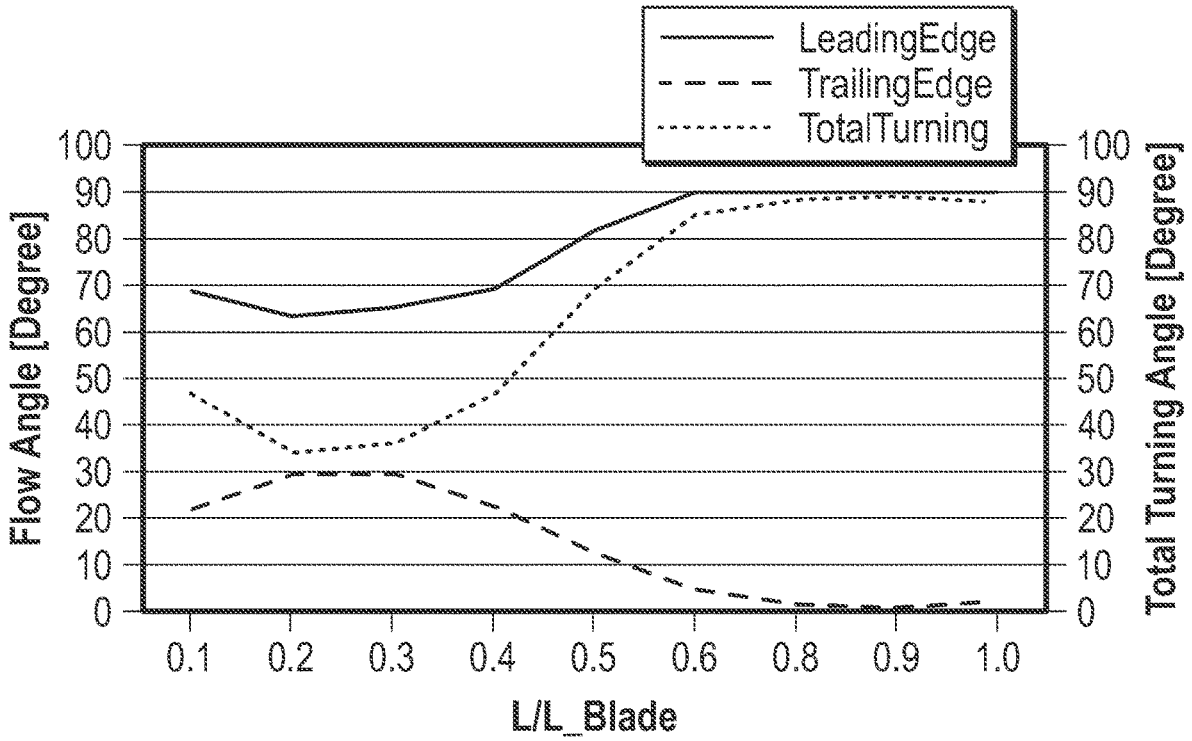
FIG. 8 is a graph with plots of leading and trailing edge flow angles and total turning angle versus blade length.

FIG. 8 is a graph illustrating the leading and trailing edge flow angles and the total turning angle over the blade length (in dimensionless units) in one embodiment. Table 1 summarizes values of flow angles and total turning angles as shown in FIG. 8, where L is the blade length location, L_blade is the total blade length, L/L_blade is a fraction of the blade length at the blade length location L (this value multiplied by 100 is the percentage of blade length L from the root), Beta1 is the leading edge flow angle, Beta2 is the trailing edge flow angle, and ΔBeta is the total flow angle (representative of blade camber). As shown in FIG. 8 and Table 1, the total turning angle can decrease from the root (or at least from 10% of the blade length) to approximately 20% of the blade length, then increase to approximately 90% of the blade length, and then decrease to the tip (100% blade length). The rate of change of the total turning angle can decrease staring at approximately 60% of the blade length. Additionally, the flow and Beta1 and Beta 1 can each decrease from the root (or at least from 10% of the blade length) to approximately 20% of the blade length, then increase further away from the root. The flow angle Beta1 at the LE can be substantially constant from approximately 60% to 100% of the blade length, and the flow angle Beta2 at the TE can decrease slightly from approximately 90% to 100% of the blade length. The flow angle Beta1 at the LE can be significantly greater than the flow angle Beta2 at the TE from the root (or at least from 10% of the blade length) to approximately 50% to 60% of the blade length and then Beta1 and Beta2 can have similar values from that point to 100% of the blade length. It should be noted that the values given in Table 1 and FIG. 8 are provided by way of example only. Embodiments of the present invention can be scaled as desired for particular applications. Furthermore, in some embodiments, tip trimming of the blade tips 24-5 can be performed to shorten the blades 24 and omit tip portions described herein.

TABLE 1

| Diameter | L/L_blade | Beta1 | Beta2 | ΔBeta |
|---|---|---|---|---|
| 400 | 0.1 | 68.7 | 22 | 46.7 |
| 450 | 0.2 | 63.4 | 29.4 | 34 |
| 500 | 0.3 | 65.4 | 29.5 | 35.9 |
| 550 | 0.4 | 69.3 | 22.6 | 46.7 |
| 600 | 0.5 | 81.8 | 12.6 | 69.2 |
| 650 | 0.6 | 90 | 4.7 | 85.3 |
| 700 | 0.8 | 90 | 1.6 | 88.4 |

TABLE 1-continued

| Diameter | L/L_blade | Beta1 | Beta2 | ΔBeta |
|---|---|---|---|---|
| 750 | 0.9 | 90 | 0.8 | 89.2 |
| 813 | 1.0 | 90 | 2.2 | 87.8 |

Figure 7:
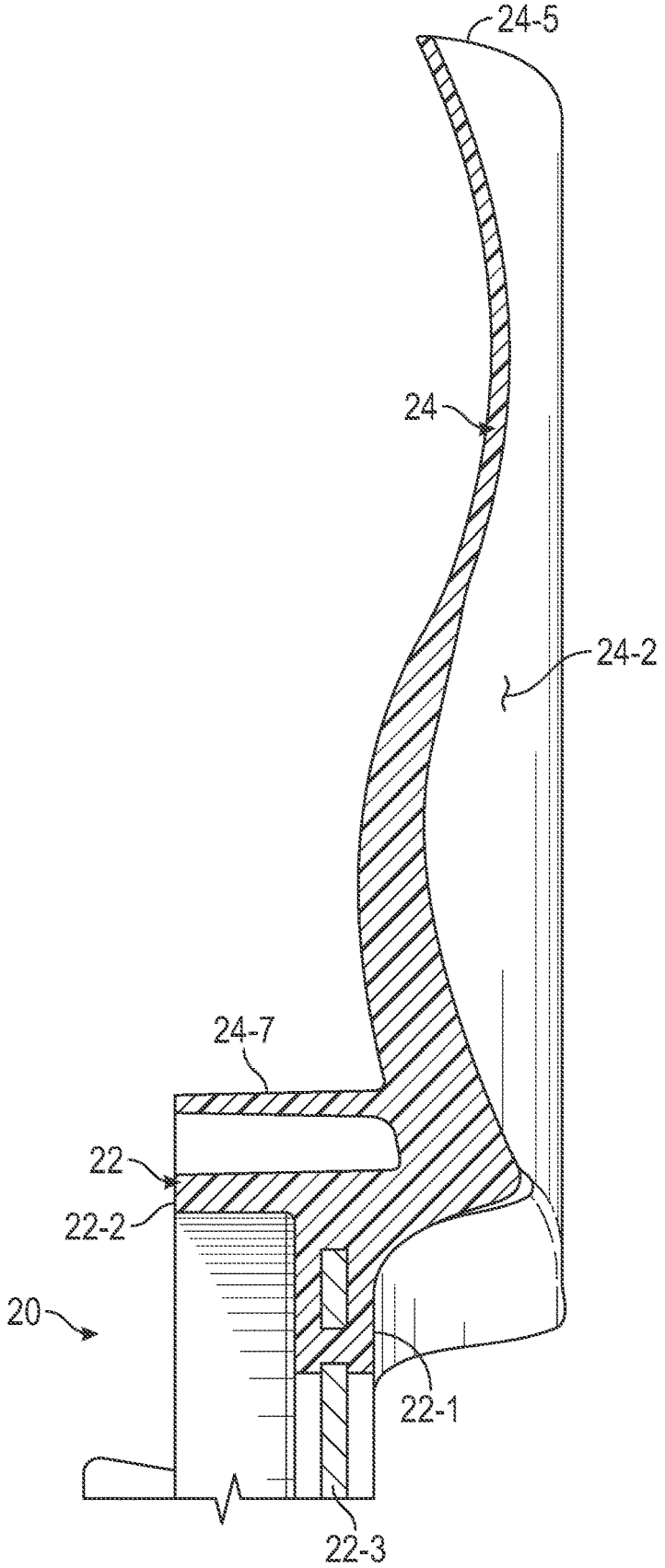
FIG. 7 is a sectional view of a blade of the fan of FIGS. 2-6, taken at a mid-chord location.

Furthermore, in some embodiments (see, e.g., FIG. 7), the blades 24 can each have a locally increased thickness at a mid-chord location that extends from the root 24-6 (or at least from 10% of the blade length) to approximately midway along the blade length (i.e., from 0% to approximately 45-50% of the total blade length). The thickness can gradually decrease from the root 24-6 (or at least from 10% of the blade length) toward the tip 24-5, such that the local thickness increase (or bulge) gradually reduces to a nominal blade thickness approximately midway along the blade length, following a hyperbolic curve in blade thickness (that is, following a mathematical hyperbolic function). Put another way, the thickness at the mid-chord location can be substantially greater than (e.g., at least twice) the thickness of either the LE 24-3 or the TE 24-4 at the root 24-6 (or at least from 10% of the blade length), and at 50% of the blade length the mid-chord thickness is the comparable to (e.g., the same or less than) the LE and/or TE thickness. This local thickness increase can help to control stresses.

Figure 9:
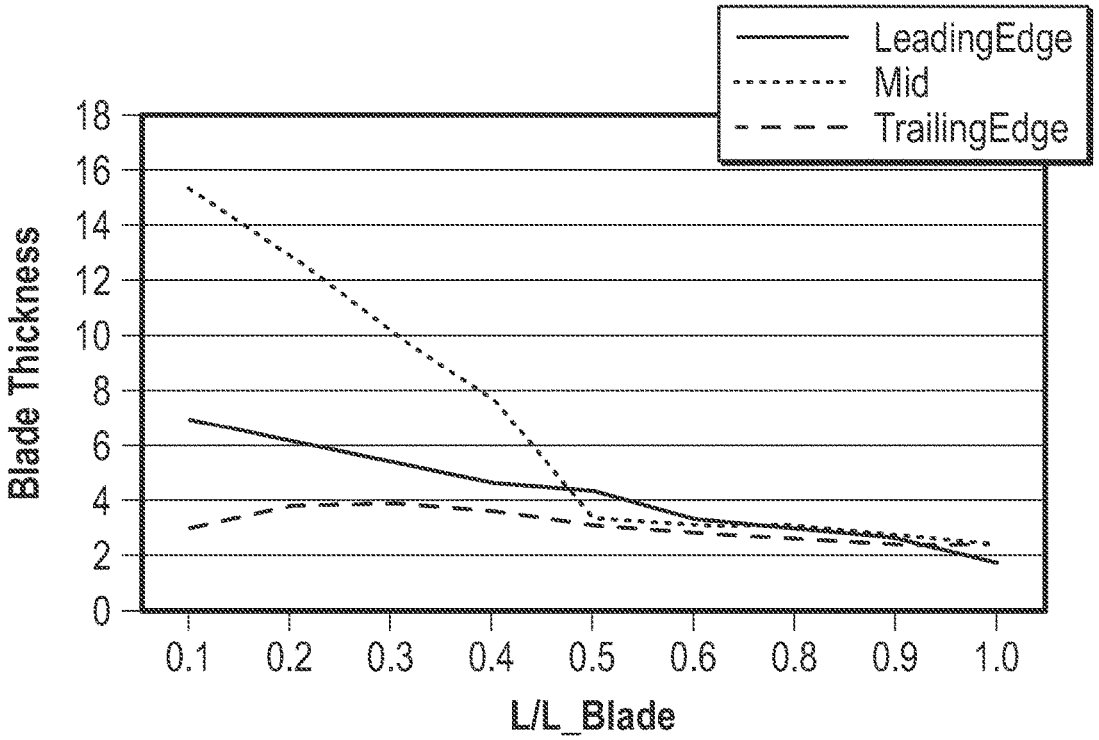
FIG. 9 is a graph with plots of blade thickness versus blade length position at leading edge, mid-chord, and trailing edge positions for an example blade.

FIG. 9 is a graph of blade thickness versus blade length location (L/L_blade) at LE mid-chord (MID) and TE locations in one embodiment. Table 2 summarizes dimensionless values of blade thickness as shown in FIG. 9. As shown in the illustrated embodiment, the mid-chord thickness decreases rapidly from a maximum at the root (or at least from 10% of the blade length), then decreases slowly to 100% of the blade length, forming a generally L-shaped or "hockey stick" plot on the illustrated graph. It should be noted that the values given in Table 2 and FIG. 9 are provided by way of example only. Embodiments of the present invention can be scaled as desired for particular applications. Furthermore, in some embodiments, tip trimming of the blade tips 24-5 can be performed to shorten the blades 24 and omit tip portions described herein.

TABLE 2

| | | Thicknesses | | |
|---|---|---|---|---|
| Diameter | L/L_blade | LE | MID | TE |
| 400 | 0.1 | 6.9 | 15.3 | 3 |
| 450 | 0.2 | 6.13 | 12.9 | 3.8 |
| 500 | 0.3 | 5.42 | 10.1 | 3.9 |
| 550 | 0.4 | 4.61 | 7.7 | 3.6 |
| 600 | 0.5 | 4.33 | 3.33 | 3.11 |
| 650 | 0.6 | 3.3 | 3.1 | 2.8 |
| 700 | 0.8 | 3 | 3.1 | 2.6 |
| 750 | 0.9 | 2.6 | 2.8 | 2.4 |
| 813 | 1.0 | 1.75 | 2.4 | 2.4 |

In some embodiments (see, e.g., FIGS. 4 and 6), the blades 24 can each have a pocket shape, with a radially outward straight section 240 and a radially inward curved section 241, in which the curved section 241 provides dihedral curvature, that is, curvature measured in a direction perpendicular to chord, which can be concave at the pressure side 24-1 of each blade 24. The straight section 240 can have essentially no dihedral curvature, at least at the TE 24-4 (and/or the LE 24-3).

In some embodiments (see, e.g., FIGS. 3 and 4), the blades 24 can each have swept leading and trailing edges 24-3 and 24-4. Measured geometrically in the tangential direction, the leading and trailing edges 24-3 and 24-4 can each have rearward then forward sweep from the root 24-6 (or at least from 10% of the blade length) to the tip 24-5. For example, the LE 24-3 can have rearward sweep from 0% (or at least 10%) to approximately 60% of the blade length and forward sweep to the tip 24-5 (100% blade length), and the TE 24-4 can have rearward sweep from 0% (or at least 10%) to approximately 50% of the blade length and forward sweep to the tip 24-5 (100% blade length).

Figure 10:
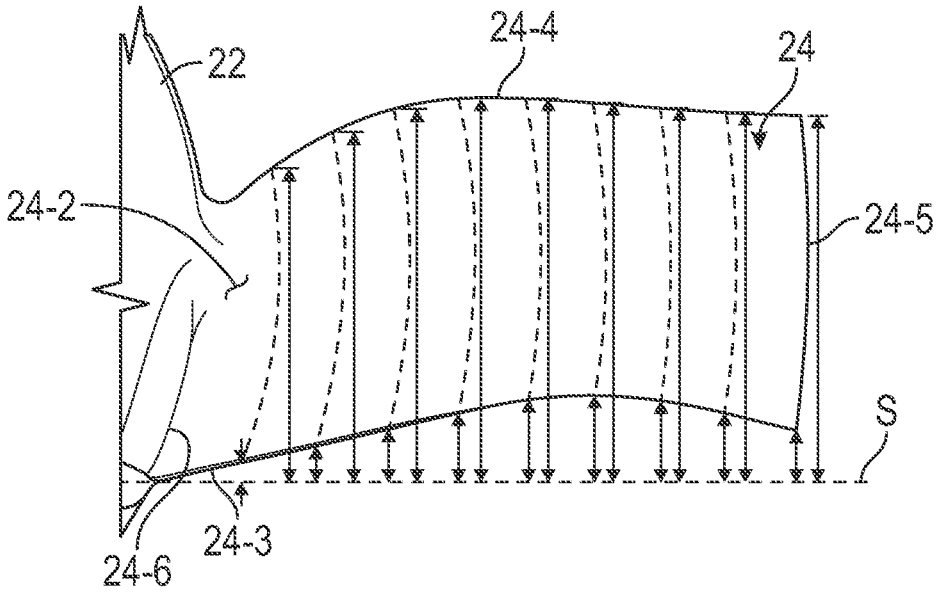
FIG. 10 is a front elevation view of the fan of FIGS. 2-7 showing example tangential edge measurements.
Figure 11:
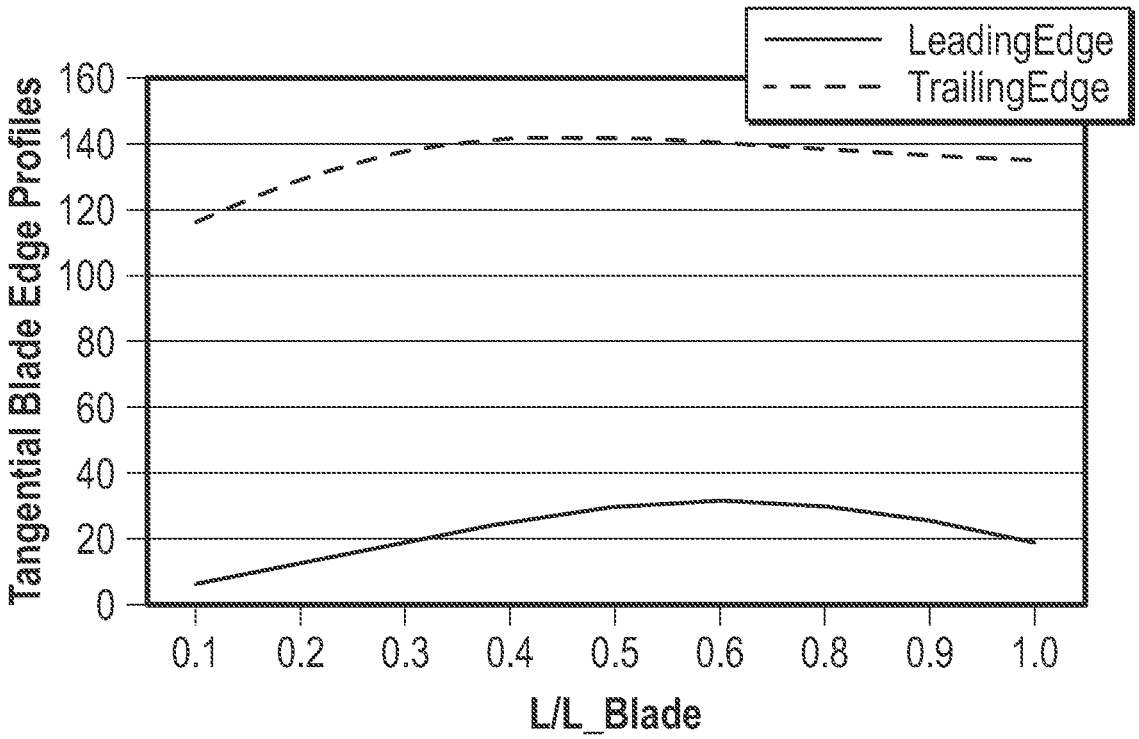
FIG. 11 is a graph with plots of tangential leading and trailing edge profiles versus blade length position for an example blade.

FIG. 10 illustrates tangential sweep (or lean) measurements for the leading edge (Y_LE) and the trailing edge (Y_TE), in dimensionless units from a radial reference line S tangent to the LE 24-3 at 0% blade length. Reference lines on the pressure side 24-1 of the blade 24 are shown in FIG. 10 for illustrative purposes only. FIG. 11 is a graph of plots of the leading and trailing edge tangential profiles versus blade length, following the measurement convention shown in FIG. 10. Table 3 summarizes dimensionless values of edge locations and tangential chord length as shown in FIG. 11. It should be noted that the values given in Table 3 and FIG. 11 are provided by way of example only. Embodiments of the present invention can be scaled as desired for particular applications. Furthermore, in some embodiments, tip trimming of the blade tips 24-5 can be performed to shorten the blades 24 and omit tip portions described herein.

TABLE 3

| Diameter | L/L_blade | Y_LE | Y_TE | Tangential Chord Length |
|---|---|---|---|---|
| 400 | 0.1 | 6.4 | 116.5 | 110.1 |
| 450 | 0.2 | 12.8 | 129.6 | 116.8 |
| 500 | 0.3 | 19.1 | 138.1 | 119 |
| 550 | 0.4 | 25.1 | 141.8 | 116.7 |
| 600 | 0.5 | 29.7 | 141.9 | 112.2 |
| 650 | 0.6 | 31.5 | 140.2 | 108.7 |
| 700 | 0.8 | 29.8 | 138.3 | 108.5 |
| 750 | 0.9 | 25.4 | 136.5 | 111.1 |
| 813 | 1.0 | 19 | 135 | 116 |

In some embodiments (see. e.g., FIGS. 7 and 12A), the blades 24 can each have a dimple that bulges outward (e.g., substantially convexly) from the suction side 24-2. Put another way, the blades 24 can have a profile that forms an S-shape in a dihedral direction, at least at a mid-chord region.

Figure 12A:
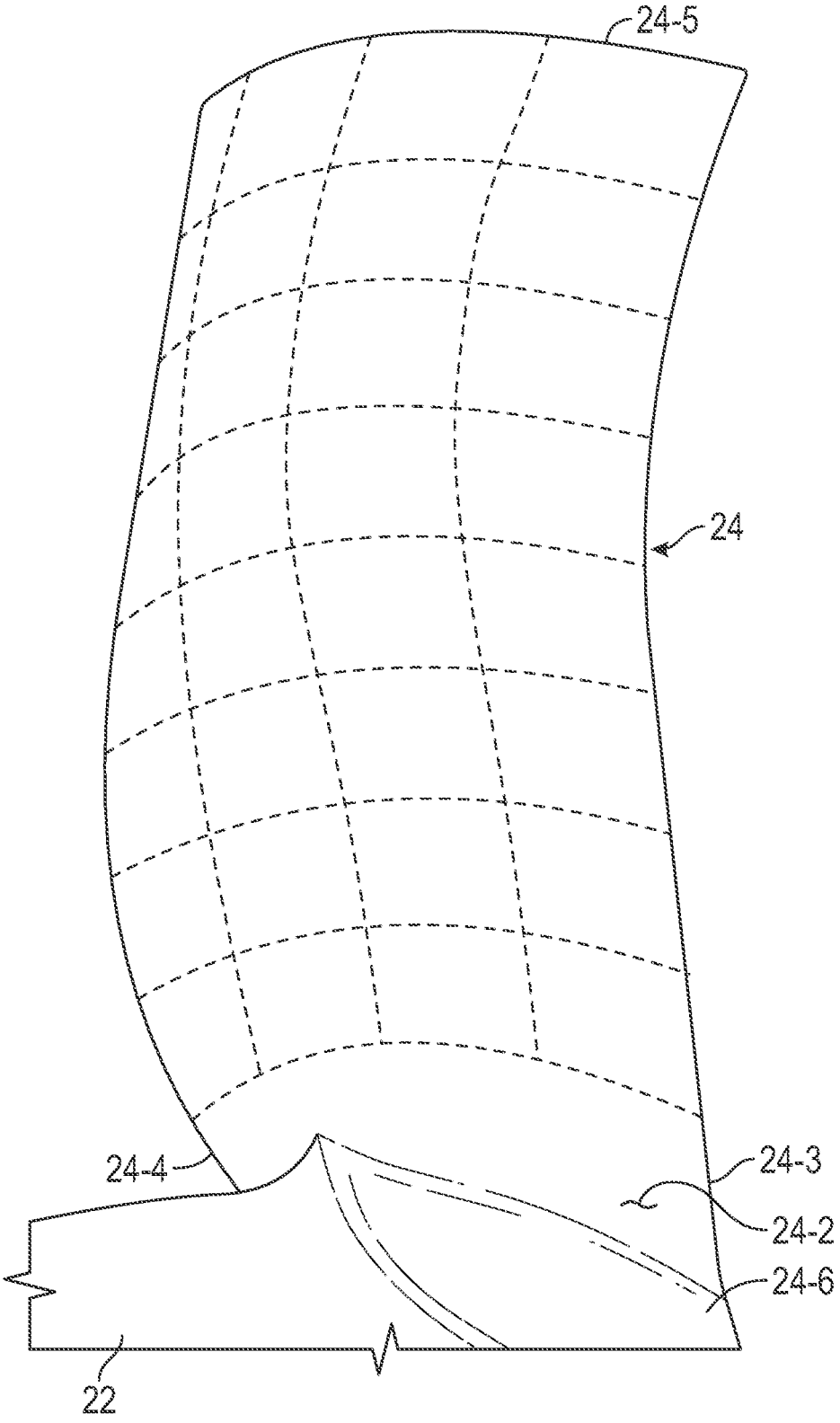
FIGS. 12A and 12B illustrate a measurement grid and an example axial dihedral measurement of a blade of the fan of FIGS. 2-7 and 10.
Figure 12B:
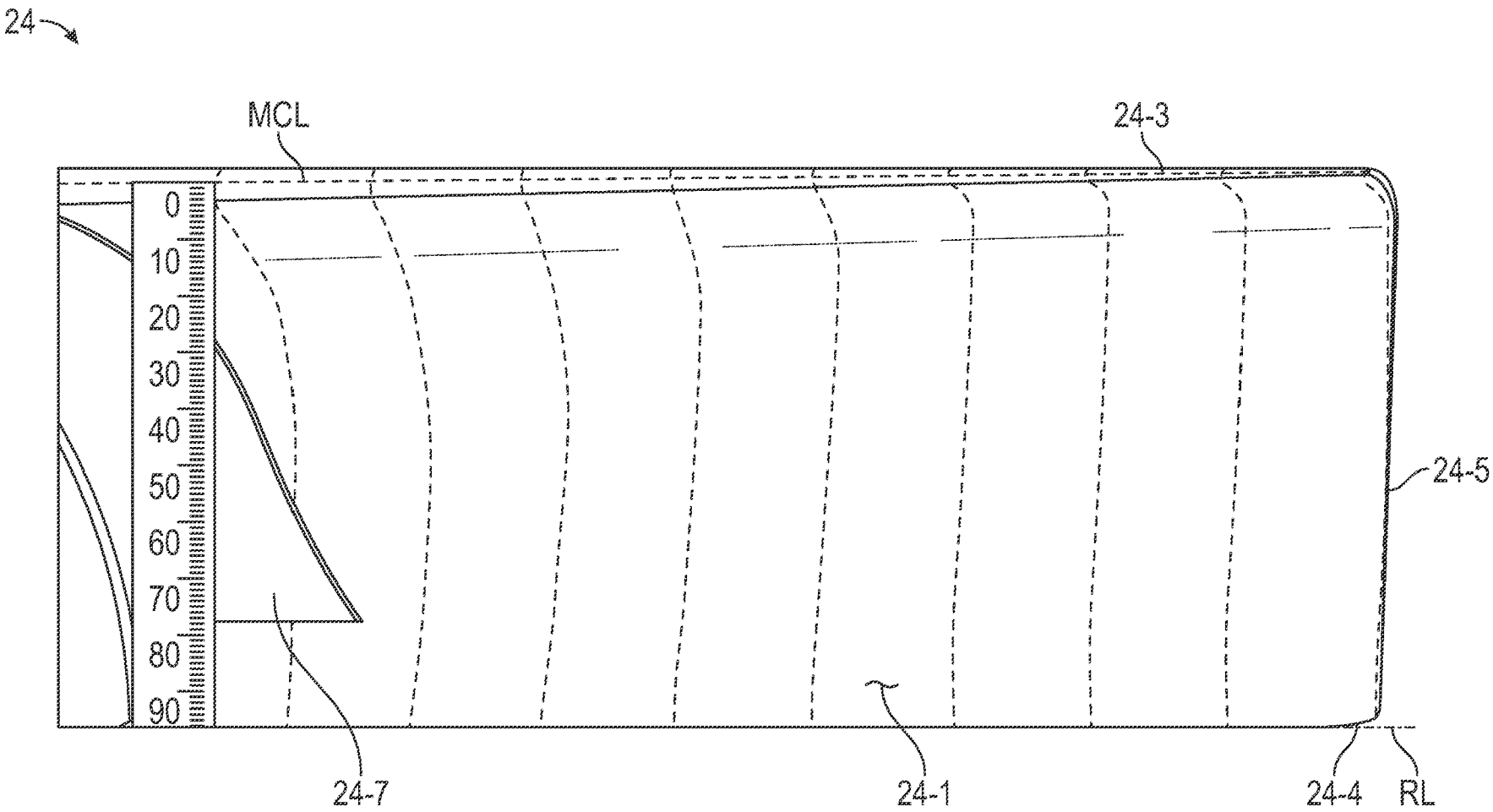
Figure 13:
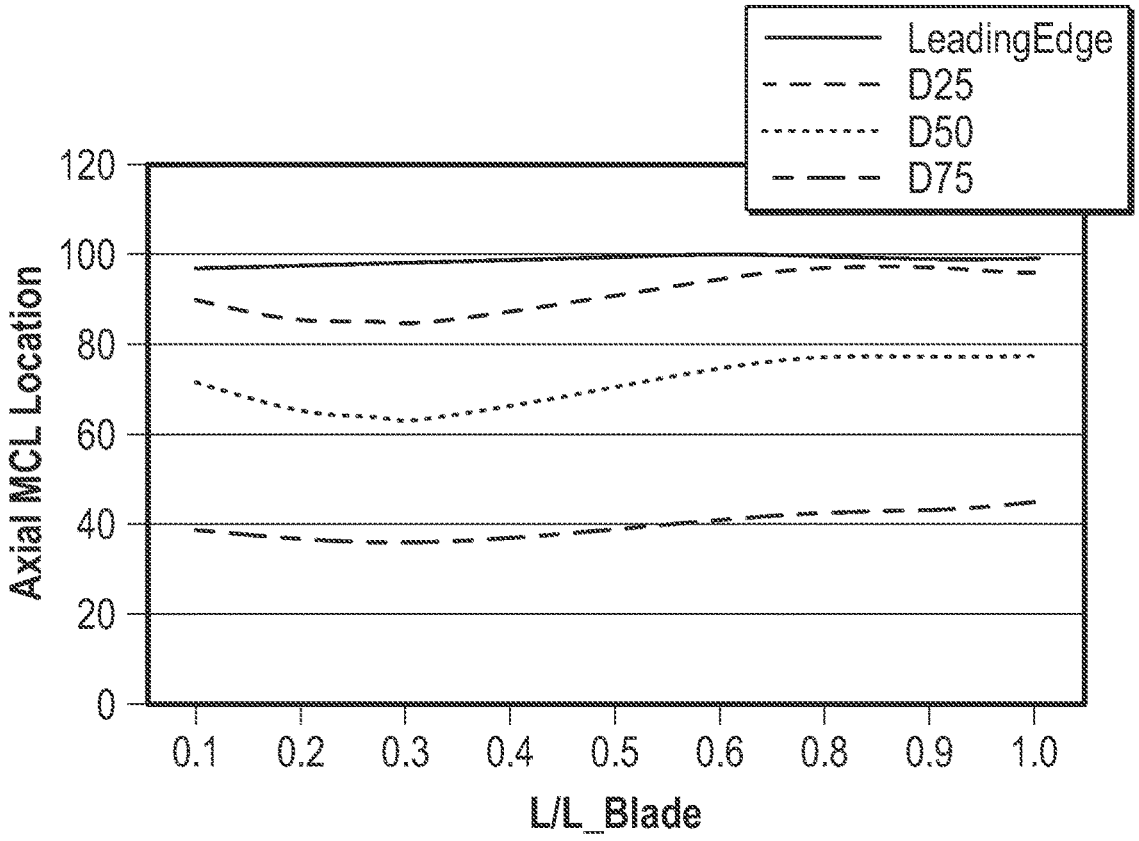
FIG. 13 is a graph with plots of axial mean camber line location versus blade length position at four chordally-spaced positions for an example blade.

FIG. 12A shows a reference grid on the suction side 24-2 used to establish intersection points where axial location measurements are taken relative to a reference line RL (see FIG. 12B), and FIG. 12B illustrates an example axial measurement of a mean camber line (MCL), indicative of blade dihedral characteristics, taken relative to the projected reference line RL extending radially at a fixed axial location (e.g., coincident with a portion of the TE 24-4 that is axially linear, that is, appearing linear when viewed perpendicular to the axis A). FIG. 13 is a graph of distances Dc (in dimensionless units) of the mean camber line from the reference line RL (at the fixed axial location) versus blade length at chordally-spaced locations c, where c indicates a percentage chord position from the LE 24-3 to the TE 24-4 at the root (0% blade length). Four chordally-spaced positions (0%, 25%, 50% and 75% chord) are plotted versus blade length as $D_0$ (or LE), $D_{25}$, $D_{50}$ and $D_{75}$ in FIG. 13, following the layout of the grid and reference line RL shown in FIGS. 12A and 12B. Table 4 summarizes dimensionless values of edge locations and tangential chord length as shown in FIG. 18 plus at 100% chord ($D_{100}$ or the TE). It should be noted that the values given in Table 4 and FIGS. 12B and 13 are provided by way of example only. Embodiments of the present invention can be scaled as desired for particular applications. Furthermore, in some embodiments, tip trimming of the blade tips 24-5 can be performed to shorten the blades 24 and omit tip portions described herein.

TABLE 4

| Diameter | L/L_blade | $D_0$ (LE) | $D_{25}$ | $D_{50}$ | $D_{75}$ | $D_{100}$ (TE) |
|---|---|---|---|---|---|---|
| 400 | 0.1 | 97.05 | 88.85 | 70.9 | 37.97 | — |
| 450 | 0.2 | 97.6 | 84.23 | 64.64 | 35.42 | 0 |
| 500 | 0.3 | 98.13 | 83.24 | 62.57 | 34.67 | 0 |
| 550 | 0.4 | 98.5 | 85.96 | 65.55 | 36.37 | 0 |
| 600 | 0.5 | 98.62 | 89.47 | 69.39 | 38.21 | 0 |
| 650 | 0.6 | 99.8 | 93.78 | 74.41 | 40.58 | 0 |
| 700 | 0.8 | 99.08 | 95.59 | 76.57 | 41.64 | 0 |
| 750 | 0.9 | 98.51 | 95.38 | 76.53 | 41.9 | 0 |
| 813 | 1.0 | 98.75 | 94.34 | 76.35 | 43.42 | — |

Figure 6:
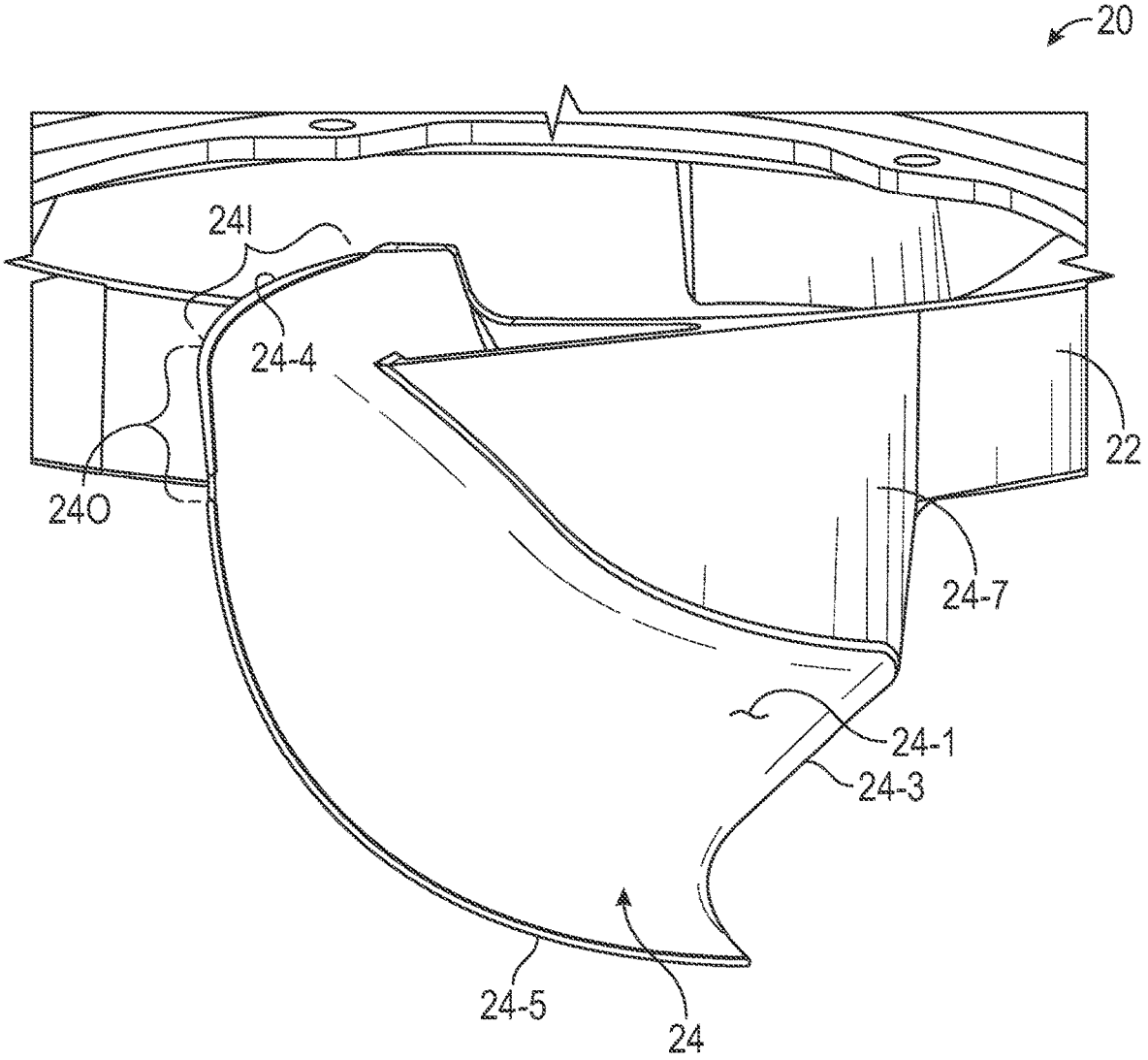
FIG. 6 is perspective views of a portion of the fan of FIGS. 2-5.

Additionally, some embodiments of the fan 20 can have blades 24 with relatively high stagger angles, measured as the angle between a ling parallel to the axis of rotation and a projected line that intersects the LE 24-3 and the TE 24-4 (see, e.g., FIG. 6). Moreover, in some embodiments (see, e.g., FIG. 6), the blades 24 can have relatively little or no twist along the blade length between the root 24-6 and the tip 24-5.

Figure 14:
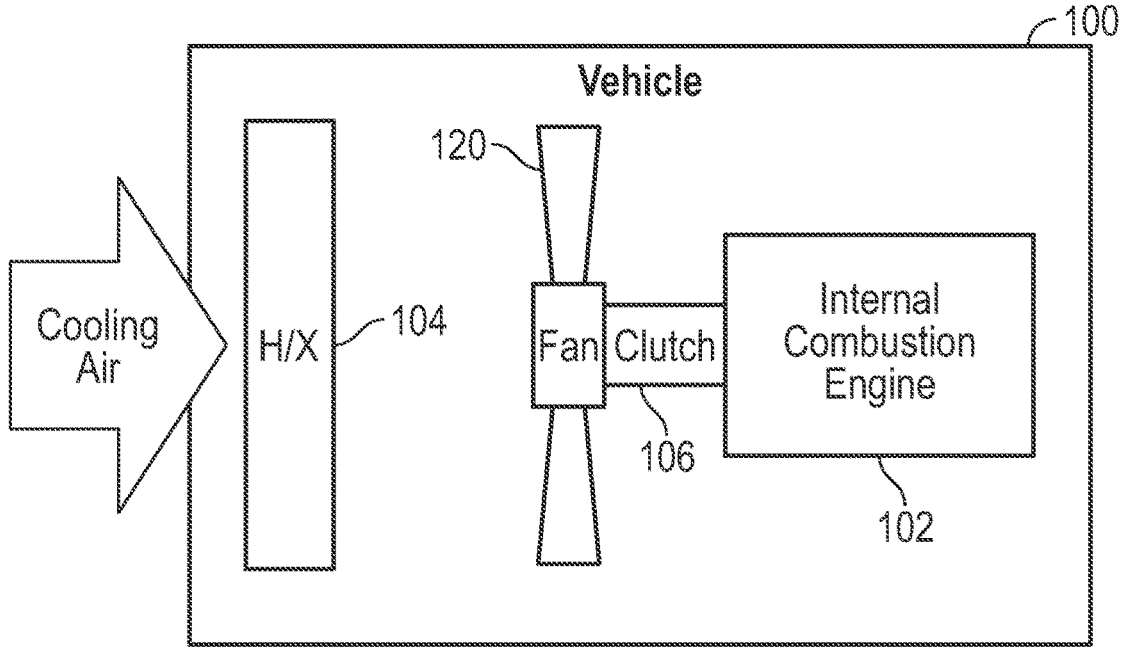
FIG. 14 is a schematic representation of an embodiment of a vehicle.

FIG. 14 is a schematic representation of a vehicle 100 having an internal combustion engine 102, a heat exchanger (H/X) 104 for cooling the engine, a clutch 106 powered by the engine, and a fan 120 connected to an output of the clutch. The heat exchanger 104, the clutch 106 and the fan 120 can be considered part of an engine cooling system. In one embodiment, the heat exchanger 104 is an air-to-liquid heat exchanger such as a radiator or the like. The fan 120 can be configured like the fan 20 shown and described with respect to FIGS. 2-13, and can be positioned proximate to the heat exchanger 104, such as in between the heat exchanger 104 and the engine 102. The clutch 106 can be engaged in an "on" condition to selectively rotate the fan 120 to generate a cooling air flow that passes through (or around or otherwise relative to) the heat exchanger 104 and toward the engine 102. Such a cooling airflow can be drawn into an engine compartment of the vehicle 100 by the fan 120, though a portion of the cooling airflow may be produced or augmented by movement of the vehicle 100 under certain operating conditions. When the clutch 106 and the fan 120 are in an "off" condition and the vehicle 100 is moving, ram air can flow through (or around or otherwise relative to) the heat exchanger 104, past or through the fan 120, and toward the engine 102. In this respect, the cooling air flow can be entirely ram air when the clutch 106 and the fan 120 are in an "off" condition. However, as discussed above, the solidity of the fan 120 impacts the flow resistance to cooling air flow through the heat exchanger 104 and toward the engine 102.

Figure 1B:
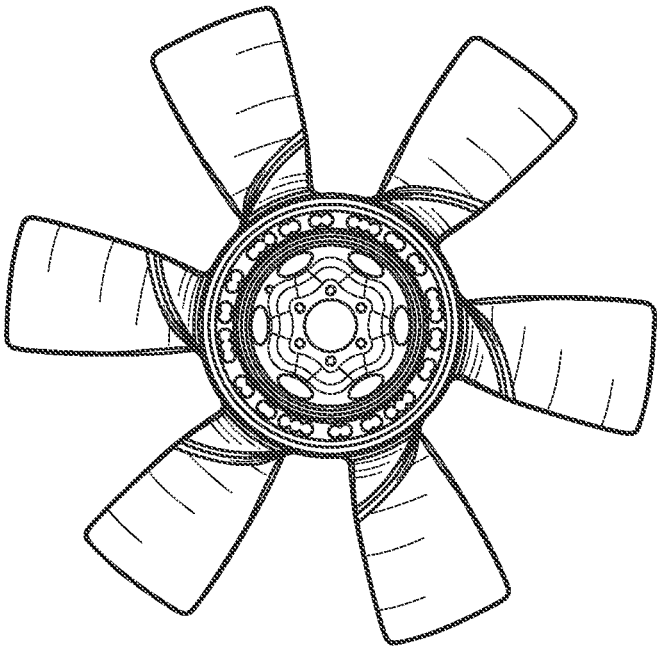
FIG. 1B (Prior Art)
Figure 2:
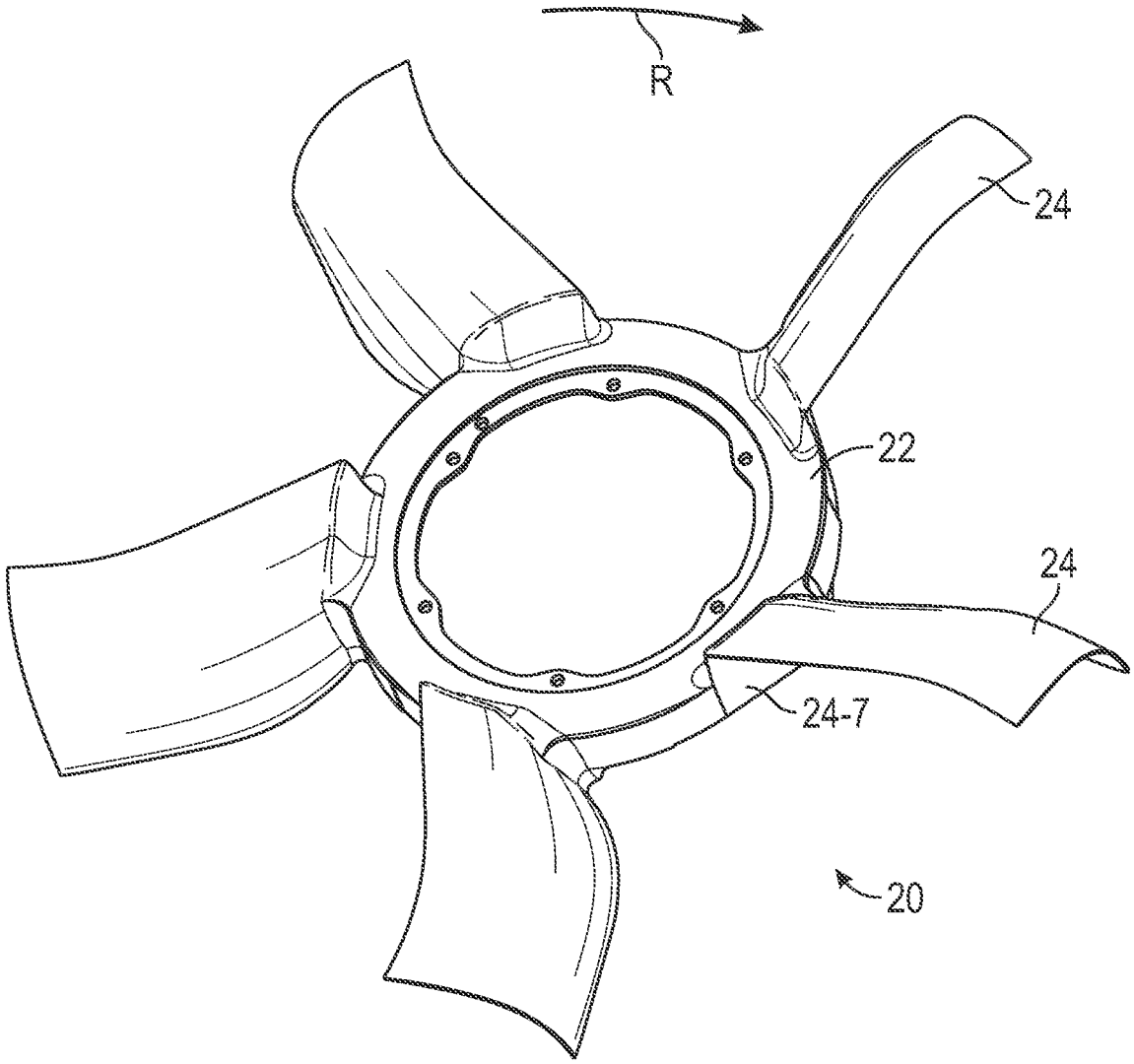
FIG. 2 is a front perspective view of an embodiment of a fan according to the present invention.
Figure 3:
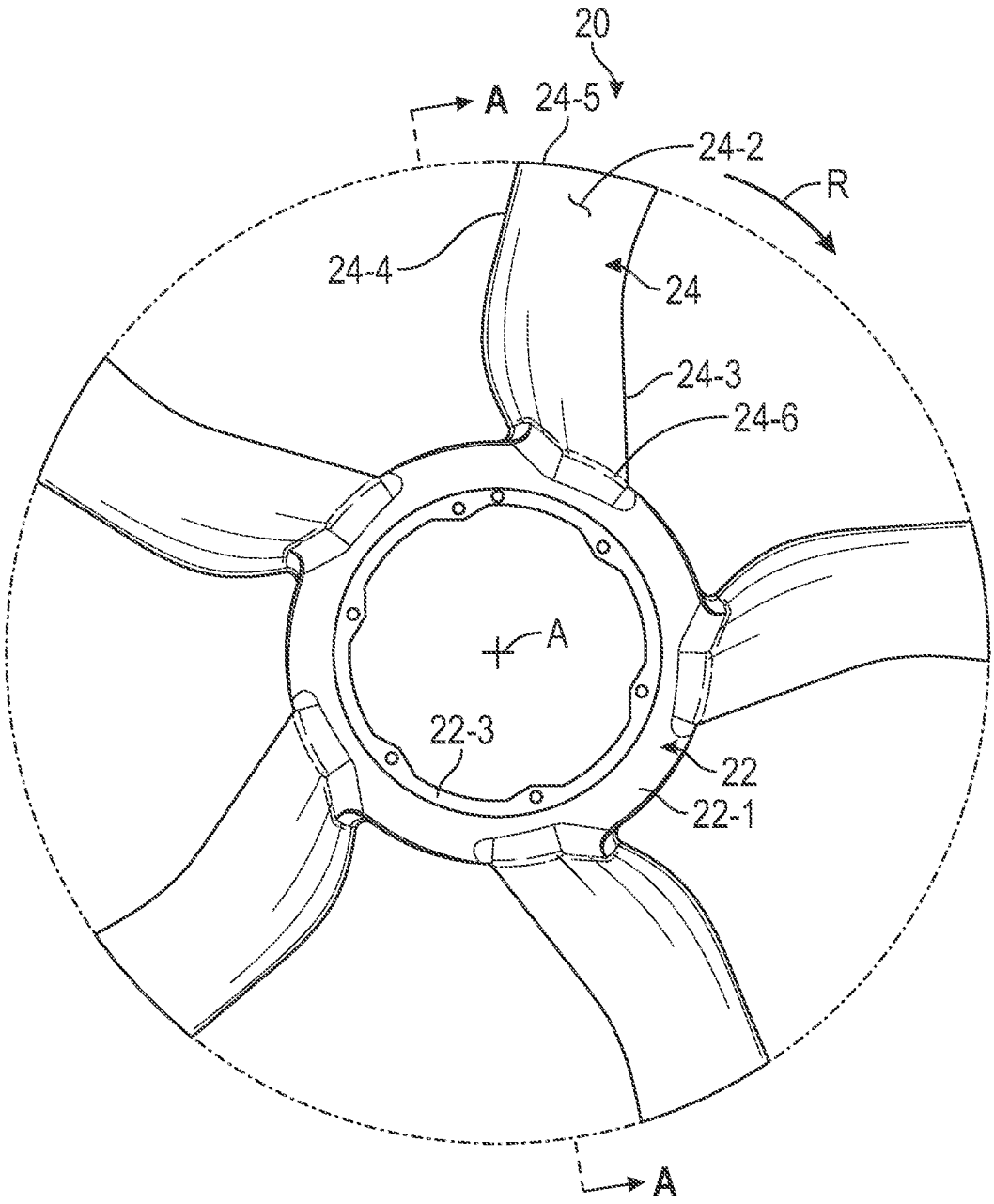
FIG. 3 is a front elevation view of the fan of FIG. 2.
Figure 4:
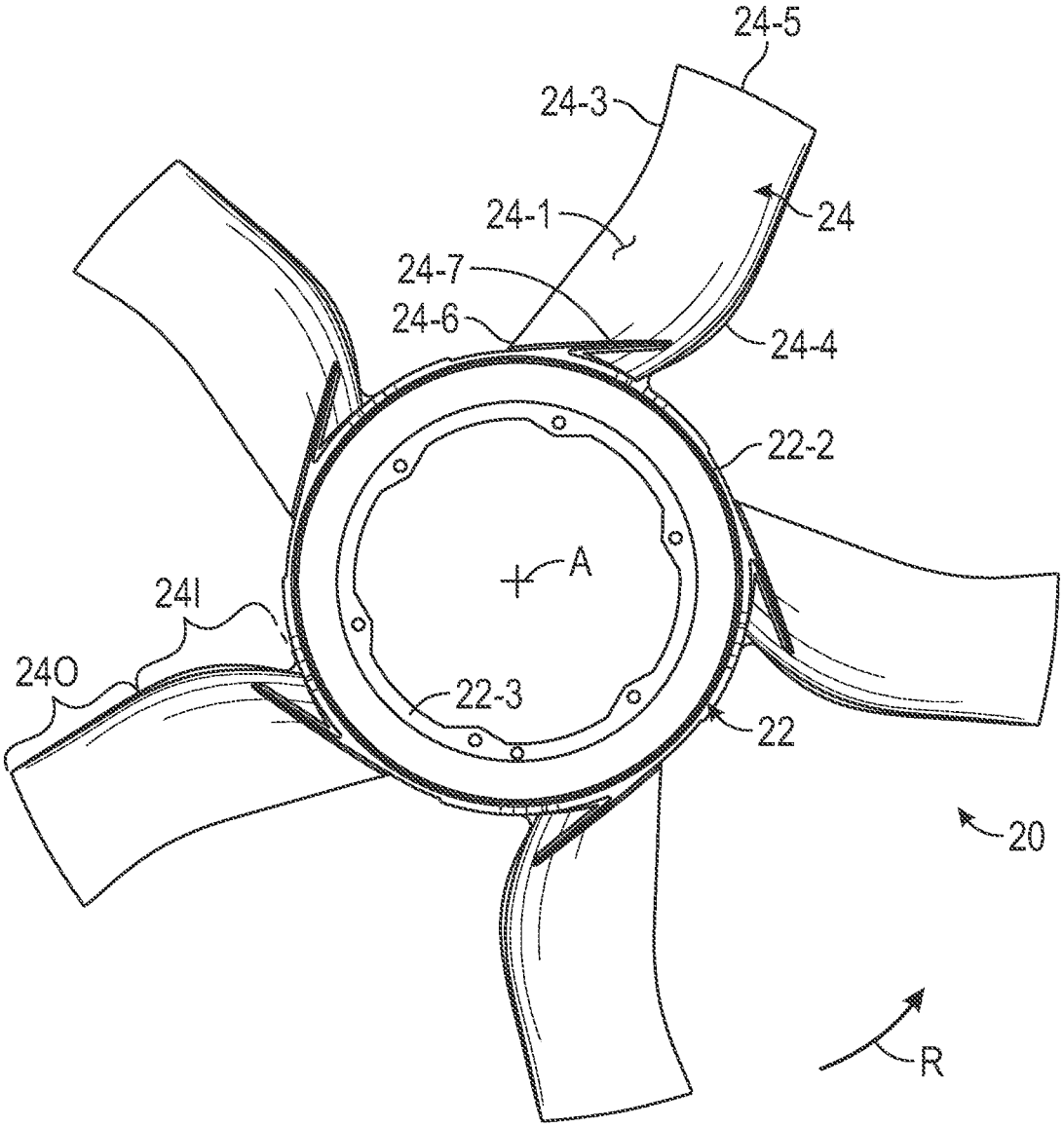
FIG. 4 is a rear elevation view of the fan of FIGS. 2 and 3.
Figure 5:
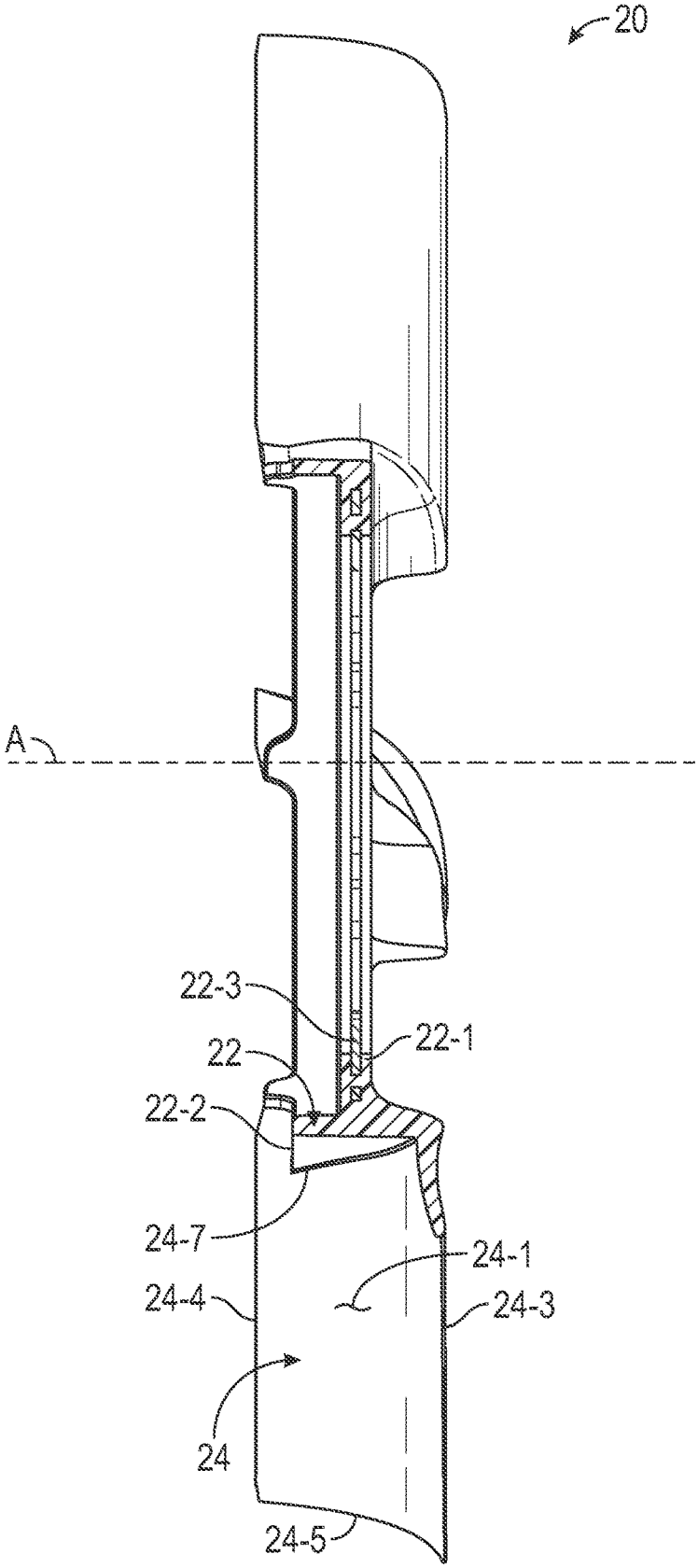
FIG. 5 is a cross-sectional view of the fan, taken along line A-A of FIG. 3.
Figure 15:
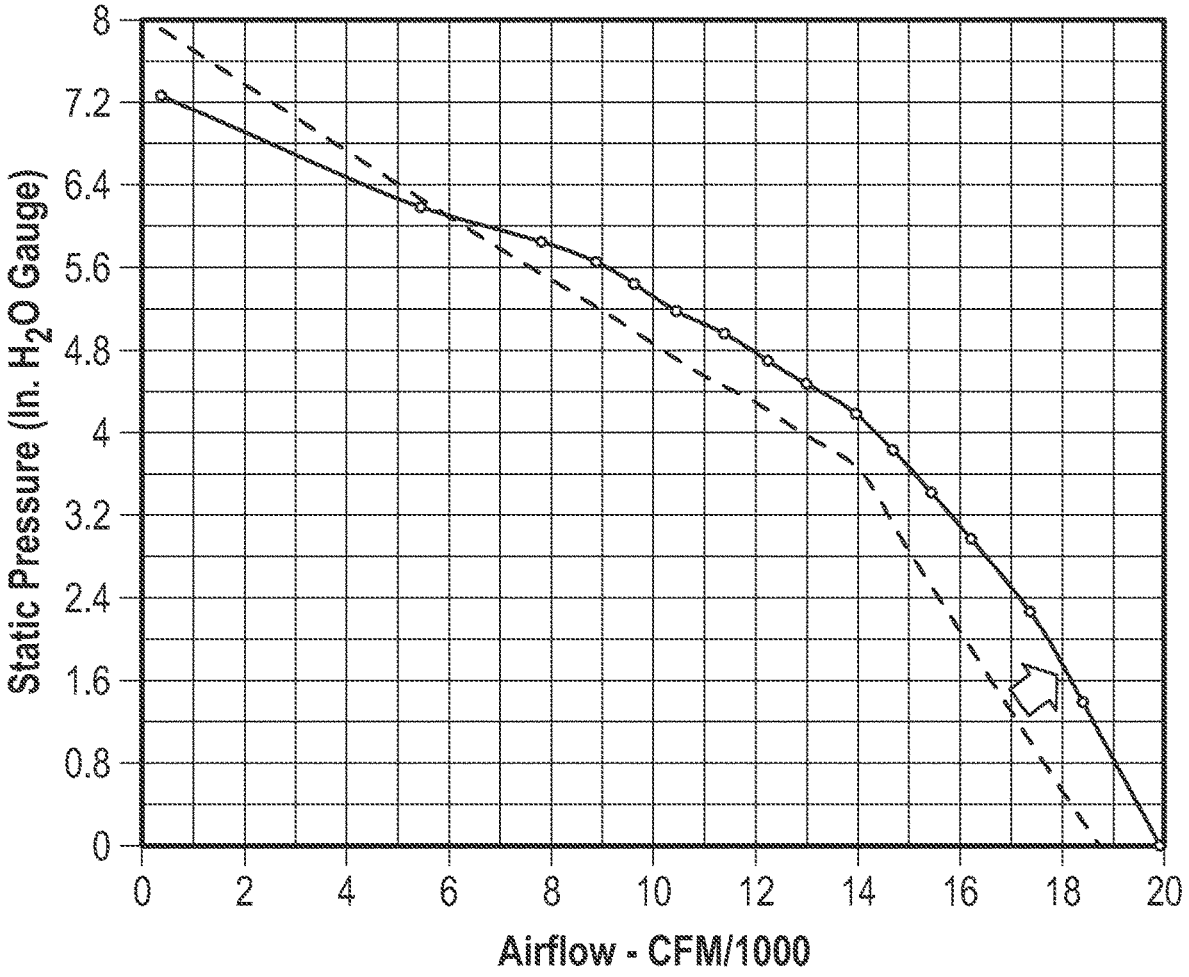
FIG. 15 is a graph of comparative performance values for an embodiment of the presently-disclosed fan and of the prior art fan of FIGS. 1A and 1B.

The present five-blade fan is capable of delivering more flow and pressure at most operating conditions, while having approximately half the solidity of typical six-blade vehicular engine cooling fans. For instance, the plot in the graph of FIG. 15 shows static pressure (in inches of water gauge) versus airflow (in cubic feet per minute (CFM)/1000), illustrating increased static pressure (indicated by an arrow) for a fan of the present disclosure over the prior art 6-blade fan of FIGS. 1A and 1B at most airflow conditions, namely at airflow conditions of approximately 6,000 CFM (170 $m^3$/minute) and above. Although not specifically illustrated in the graph of FIG. 15, the lower solidity of the tested embodiment of the present fan compared to the prior art 6-blade fan (22.7% versus 46.9%) also means that ram air cooling efficiency is greater than the prior art during "off" conditions. Thus, the presently disclosed fan provided improved performance over most operating conditions, including during "off" conditions and during relatively high rotation speed "on" conditions, resulting in improved overall performance across typical on-highway vehicle operational conditions.

Numerous other features and benefits of the present invention will be recognized by those of ordinary skill in the art in view of the entirety of the present disclosure, including the accompanying figures.

Discussion of Possible Embodiments

An axial flow fan for use with a vehicle cooling system can include a hub defining an axis of rotation, and a plurality of blades supported on the hub, the plurality of blades including at least five blades. Each blade can include a leading edge, a trailing edge opposite the leading edge, a pressure side extending between the leading edge and the trailing edge, a suction side opposite the pressure side, a tip, and a root opposite the tip along a blade length. A solidity of the axial flow fan, measured as a percentage of an annular flow area between an outer diameter of the hub and an outer diameter of the tips of the plurality of blades projected onto a plane perpendicular to the axis of rotation that is occupied by the plurality of blades, can be less than 40%.

The axial flow fan of the preceding paragraph can optionally include, additionally and/or alternatively, any one or more of the following features, configurations and/or additional components:

the solidity can be less than 33%, less than 25%, or approximately 22.7%;

the plurality of blades can consist of five blades;

each of the plurality of blades can further include a hub ramp on the pressure side;

a maximum total turning angle along the blade length of each of the plurality of blades can be greater than 50°, greater than or equal to 80°, greater than or equal to approximately 89°, or approach 90°;

a total turning angle can vary along the blade length of each of the plurality of blades;

a minimum total turning angle along the blade length of each of the plurality of blades can be greater than or equal to 30° or greater than or equal to 35°;

a total turning angle along the blade length of each of the plurality of blades can decrease from 0% to approximately 20% of the blade length, then increase to approximately 90% of the blade length, then decrease to 100% of the blade length;

each of the plurality of blades can have rearward then forward tangential sweep from 0% to 100% of the blade length along both the leading edge and the trailing edge;

each of the plurality of blades can have a radially inner section having dihedral curvature that is concave at the pressure side and a radially outward straight section having essentially no dihedral curvature at the trailing edge;

each of the plurality of blades can have a dimple along the suction side at a mid-chord location, where chord is measured between the leading edge and the trailing edge;

each of the plurality of blades has a bulge formed by a local thickness increase at a mid-chord location that decreases from 0% to a location at 40% to 50% of the blade length, where chord is measured between the leading edge and the trailing edge;

the local thickness increase at the mid-chord location that forms the bulge can be at least twice a thickness of either or both of the leading edge and the trailing edge at 0% of the blade length; and/or the local thickness increase at the mid-chord location can decrease according to a hyperbolic curve.

A vehicle can include an internal combustion engine, a heat exchanger for cooling the internal combustion engine, an axial flow fan, and a clutch for selectively rotating the axial flow fan. The heat exchanger can be exposed or be at least exposable to ram air when the vehicle is moving in at least one direction. The axial flow fan can be positioned proximate to the heat exchanger. Rotation of the axial flow fan can move cooling air relative to the heat exchanger. The axial flow fan can be configured as described in any of the preceding paragraphs of these possible embodiments.

An axial flow fan includes a hub defining an axis of rotation, and exactly five blades integrally and monolithically formed with at least a portion of the hub. Each of the five blades can be free-tipped and can include a leading edge, a trailing edge opposite the leading edge, a pressure side extending between the leading edge and the trailing edge, a suction side opposite the pressure side, a tip, a root opposite the tip along a blade length, and a hub ramp on the pressure side. A solidity of the axial flow fan, measured as a percentage of an annular flow area between an outer diameter of the hub and an outer diameter of the tips of the five blades projected onto a plane perpendicular to the axis of rotation that is occupied by the five blades, can be less than 25%. A maximum total turning angle along the blade length of each of the five blades can be greater than or equal to 80°.

The axial flow fan of the preceding paragraph can optionally include, additionally and/or alternatively, any one or more of the following features, configurations and/or additional components:

the solidity can be approximately 22.7%;

the maximum total turning angle can be approximately 89.2°; and/or each of the five blades can have a pocket shape defined by a radially inner section having dihedral curvature that is concave at the pressure side and a radially outward section that is essentially straight in the dihedral direction at the trailing edge and at the leading edge.

Summation

Any relative terms or terms of degree used herein, such as "substantially", "essentially", "generally", "approximately" and the like, should be interpreted in accordance with and subject to any applicable definitions or limits expressly stated herein. In all instances, any relative terms or terms of degree used herein should be interpreted to broadly encompass any relevant disclosed embodiments as well as such ranges or variations as would be understood by a person of ordinary skill in the art in view of the entirety of the present disclosure, such as to encompass ordinary manufacturing tolerance variations, incidental alignment variations, transient alignment or shape variations induced by thermal, rotational or vibrational operational conditions, and the like. Moreover, any relative terms or terms of degree used herein should be interpreted to encompass a range that expressly includes the designated quality, characteristic, parameter or value, without variation, as if no qualifying relative term or term of degree were utilized in the given disclosure or recitation.

Although the present invention has been described with reference to preferred embodiments, workers skilled in the art will recognize that changes may be made in form and detail without departing from the spirit and scope of the invention. For instance, stated dimensions can be scaled to provide a fan of nearly any desired size. Moreover, features described with respect to any embodiment can be combined with features of any other disclosed embodiment, though it is not necessary that every disclosed feature appear together in a single embodiment. Additionally, embodiments of a fan can include free-tipped blades, as shown in the accompanying figures, or can optionally include a shroud, such as in a ring fan configuration.

The invention claimed is:

1. An axial flow fan for use with a vehicle cooling system, the axial flow fan comprising:

a hub defining an axis of rotation; and a plurality of blades supported on the hub, the plurality of blades including at least five blades, each blade comprising:

a leading edge;

a trailing edge opposite the leading edge;

a pressure side extending between the leading edge and the trailing edge;

a suction side opposite the pressure side;

a tip; and a root opposite the tip along a blade length, wherein a solidity of the axial flow fan, measured as a percentage of an annular flow area between an outer diameter of the hub and an outer diameter of the tips of the plurality of blades projected onto a plane perpendicular to the axis of rotation that is occupied by the plurality of blades, is less than 40%, and wherein each of the plurality of blades has a radially inner section having dihedral curvature that is concave at the pressure side and a radially outward straight section having essentially no dihedral curvature at the trailing edge, wherein the radially outward straight section extends to the tip.

2. The axial flow fan of claim 1, wherein the solidity is less than 33%.

3. The axial flow fan of any preceding claim, wherein the solidity is less than 25%.

4. The axial flow fan of claim 1, wherein the plurality of blades consists of five blades.

5. The axial flow fan of claim 1, wherein each of the plurality of blades further comprises a hub ramp on the pressure side, and wherein each hub ramp extends to the leading edge but is spaced from the trailing edge such that each hub ramp has no effect on the solidity of the axial flow fan.

6. The axial flow fan of claim 1, wherein a maximum total turning angle along the blade length of each of the plurality of blades is greater than 50°.

7. The axial flow fan of claim 1, wherein a total turning angle varies along the blade length of each of the plurality of blades, and wherein a maximum total turning angle along the blade length of each of the plurality of blades is greater than or equal to 80°.

8. The axial flow fan of claim 1, wherein a total turning angle varies along the blade length of each of the plurality of blades, and wherein a maximum total turning angle along the blade length of each of the plurality of blades is greater than or equal to approximately 89°.

9. The axial flow fan of claim 1, wherein a minimum total turning angle along the blade length of each of the plurality of blades is greater than or equal to 30°.

10. The axial flow fan of claim 1, wherein a total turning angle along the blade length of each of the plurality of blades decreases from 0% to approximately 20% of the blade length, then increases to approximately 90% of the blade length, then decreases to 100% of the blade length.

11. The axial flow fan of claim 1, wherein each of the plurality of blades has rearward then forward tangential sweep from 0% to 100% of the blade length along both the leading edge and the trailing edge.

12. The axial flow fan of claim 1, wherein each of the plurality of blades has a dimple along the suction side at a mid-chord location, where chord is measured between the leading edge and the trailing edge.

13. The axial flow fan of claim 1, wherein chord is measured between the leading edge and the trailing edge, wherein each of the plurality of blades has a bulge formed by a local thickness increase at a mid-chord location that decreases from 0% to a location at 40% to 50% of the blade length, wherein thicknesses of each of the plurality of blades at the leading and trailing edges from 10% to 40% of the blade length are less than half the thickness at the mid-chord location at corresponding blade length locations, and wherein thickness of each of the plurality of blades at the mid-chord location does not increase between the bulge and 100% of the blade length.

14. The axial flow fan of claim 13, wherein the local thickness increase at the mid-chord location that forms the bulge is at least twice a thickness of either or both of the leading edge and the trailing edge at 0% of the blade length.

15. The axial flow fan of claim 13, wherein the local thickness increase at the mid-chord location decreases according to a hyperbolic curve.

16. A vehicle comprising:

an internal combustion engine;

a heat exchanger for cooling the internal combustion engine, wherein the heat exchanger is exposable to ram air when the vehicle is moving in at least one direction;

the axial flow fan according to claim 1, positioned proximate to the heat exchanger; and a clutch for selectively rotating the axial flow fan, wherein rotation of the axial flow fan moves cooling air relative to the heat exchanger.

17. An axial flow fan comprising:

a hub defining an axis of rotation; and exactly five blades integrally and monolithically formed with at least a portion of the hub, each of the five blades being free-tipped and comprising:

a leading edge;

a trailing edge opposite the leading edge;

a pressure side extending between the leading edge and the trailing edge;

a suction side opposite the pressure side;

a tip;

a root opposite the tip along a blade length; and a hub ramp on the pressure side, wherein a solidity of the axial flow fan, measured as a percentage of an annular flow area between an outer diameter of the hub and an outer diameter of the tips of the five blades projected onto a plane perpendicular to the axis of rotation that is occupied by the five blades, is less than 25%, and wherein a maximum total turning angle along the blade length of each of the five blades is greater than or equal to 80°; and wherein each of the five blades has a shape defined by a radially inner section having dihedral curvature that is concave at the pressure side and a radially outward section that is essentially straight in a dihedral direction at the trailing edge and at the leading edge, wherein the dihedral direction is perpendicular to chord, and wherein the radially outward straight section extends to the tip.

18. The axial flow fan of claim 17, wherein the solidity is approximately 22.7%, and wherein the maximum total turning angle is approximately 89.2°.

19. The axial flow fan of claim 17, wherein chord is measured between the leading edge and the trailing edge, wherein each of the plurality of blades has a bulge formed by a local thickness increase at a mid-chord location that decreases from 0% to a location at 40% to 50% of the blade length, wherein thickness of each of the plurality of blades at the mid-chord location does not increase between the bulge and 100% of the blade length, and wherein thicknesses of each of the plurality of blades at the trailing edge both increases and decreases along the blade length.

* * * * *